US008286553B2

(12) United States Patent
Faraz

(10) Patent No.: US 8,286,553 B2
(45) Date of Patent: Oct. 16, 2012

(54) WIFFLE-TREE PRINTING PLATE REGISTRATION SYSTEM

(75) Inventor: Ali Faraz, Port Moody (CA)

(73) Assignee: Eastman Kodak Company, Rochester, NY (US)

( * ) Notice: Subject to any disclaimer, the term of this patent is extended or adjusted under 35 U.S.C. 154(b) by 388 days.

(21) Appl. No.: 12/730,317

(22) Filed: Mar. 24, 2010

(65) Prior Publication Data

US 2011/0232518 A1 Sep. 29, 2011

(51) Int. Cl.
*B41F 13/12* (2006.01)

(52) U.S. Cl. ..... 101/485; 101/481; 33/614; 33/620

(58) Field of Classification Search ..... 101/481, 101/480, 484, 485, 486, 375, 376, DIG. 36; 33/617, 618, 619, 614, 620, 621; *B41F 13/12*
See application file for complete search history.

(56) References Cited

U.S. PATENT DOCUMENTS 5,479,859 A 1/1996 Lindner et al.
6,510,793 B1 1/2003 Kerr et al.
6,755,132 B1 6/2004 Cummings
6,766,742 B2 * 7/2004 Hashiguchi ..... 101/477
7,124,687 B2 * 10/2006 Wattyn ..... 101/481

FOREIGN PATENT DOCUMENTS

WO WO 2007/140269 12/2007

* cited by examiner

*Primary Examiner* — Judy Nguyen
*Assistant Examiner* — Jennifer Simmons
(74) *Attorney, Agent, or Firm* — Nelson Adrian Blish

(57) ABSTRACT

Apparatus (10) for registering printing plates (24) with a plurality of registration members (40A-40F), the apparatus (10) including a plate positioning system (64). The plate positioning system including a first member (50) adapted to pivot about a first pivot point and a plurality of second members (53A, 53B), each second member being pivotally coupled to the first member, and each second member comprising at least one element (58) adapted for engaging a printing plate. The apparatus includes a plurality of sensors (80A, 80B) adapted for detecting contact between the printing plates and the plurality of registration members. The plate positioning system includes a plurality of actuators (72A, 72B) coupled to the second members. An actuator in the plurality of actuators is selectively operated to apply force to an associated second member during a registration of a printing plate.

12 Claims, 5 Drawing Sheets

WIFFLE-TREE PRINTING PLATE REGISTRATION SYSTEM

FIELD OF THE INVENTION

The invention relates to printing, and in particular to registering printing plates in an apparatus such as a computer-to-plate system. Registration of the printing plate is required prior to subjecting the printing plate to forming an image on the printing plate or the forming of a registration feature on the printing plate.

BACKGROUND OF THE INVENTION

Contact printing using high volume presses is commonly employed to print a large number of copies of an image. A contact printing press typically utilizes a printing plate to apply a colorant to a surface to form an image thereon. The surface can form part of a receiver media (e.g. paper) or can form part of an intermediate component adapted to transfer the colorant from its surface to the receiver media (e.g. a blanket cylinder of a press). In either case, a colorant pattern is transferred to the receiver media to form an image on the receiver medium.

Printing plates typically undergo various processes to render them suitable for use in a printing press. For example, exposure processes are used to form images on an imageable surface of a printing plate that has been suitably treated so as to be sensitive to light or heat radiation. One type of exposure process employs masks. The masks are typically formed by exposing highly sensitive film media using a laser printer known as an "image-setter." The film media can be additionally developed to form the mask. The mask is placed in contact with a sensitized printing plate, which is in turn exposed through the mask. Printing plates exposed in this manner are typically referred to as "conventional printing plates." Some conventional lithographic printing plates are sensitive to radiation in the ultraviolet region of the light spectrum.

Another conventional method directly forms images on printing plates through the use of a specialized imaging apparatus typically referred to as a plate-setter. A plate-setter in combination with a controller that receives and conditions image data for use by the plate-setter is commonly known as a "computer-to-plate" or "CTP" system. CTP systems offer a substantial advantage over image-setters in that they eliminate film masks and any process variations associated therewith. Printing plates imaged by CTP systems are typically referred to as "digital" printing plates. Digital printing plates can include photopolymer coatings (i.e. visible light plates) or thermo-sensitive coatings (i.e. thermal plates).

In many printing processes, a plurality of printing plates is used to apply different colorants to a receiver media. Typically, each printing plate applies a different colorant to the receiver media. In this way, the printed image formed on the receiver media can contain different colors. Each of the printing plates must be registered with respect to one another to form a printed image having a desired visual quality. Regardless of the manner by which an image is formed on a printing plate, it needs to be accurately positioned on the printing plate to achieve a desired registration with the images formed on other associated printing plates.

In some cases, registration features are formed in a printing plate to help register the printing plate on a printing press. The registration features can be formed by various processes including processes adapted to form perforations in the printing plate. A set of perforations can be used to define registration features comprising locating holes or locating channels adapted for providing a desired alignment with a corresponding set of registration features on a printing press. Accurate registration requires that the registration features formed on a printing plate be registered with the images formed on the printing plate. In some cases, the image forming process and the registration feature forming process are conducted by different apparatus. In other cases, the image forming process and the registration feature forming process are conduced by the same apparatus. In some cases, the image forming process precedes the registration feature forming process while in other cases, the opposite occurs. In some cases, a registration feature formed on a printing plate is employed to assist in the accurate placement of an image on the printing plate. In other cases, an image formed on a printing plate is employed to assist in the accurate placement of a registration feature on the printing plate.

In many cases, one or more edges of a printing plate are used for registration purposes during a processing of the printing plate. For example, during some processes, a printing plate is aligned on a support surface of an apparatus by bringing one or more of the plate edges known as "registration edges" into contact with various registration members. Various groupings of registration members are often employed to register printing plates to the support surface. Once a required contact is established between the printing plate and the registration members, the printing plate is deemed to be in a required registration for a subsequent processing such as the forming of an image or a registration feature. Failure to establish the necessary contact between the printing plate and the registration members can introduce registration errors during the subsequent processing. The failure to establish the necessary contact between the printing plate and the registration members is referred to as "misregistration." Registration errors can lead to reduced quality in the finished printing plate and adversely impact the productivity of the plate making process.

Various problems are associated with positioning a printing plate against a plurality of registration members. Today's automated printing plate processing systems require printing plates to be carefully registered against various registration members without deforming the printing plates and while maintaining high processing throughputs. Printing plate deformations can take various forms including various buckling modes which can cause the entrapment of "bubbles" or other similar distortions that can lead to printing plate surface deviations during a subsequent processing operation. Printing plate deformations can also include deformations in an edge of a printing plate which lead to printing plate positional errors during a subsequent processing operation. Edge deformations can arise for different reasons, including excessive contact stresses arising during the positioning of the printing plate against the registration members.

The likelihood of printing plate deformations can increase as the size of the printing plate increases. For example, as a printing plate increases in size, so do the frictional forces between it and a support surface onto which it is positioned during the registration process. This in turn, leads to the need for larger positioning forces to register the printing plate against the registration members, thereby increasing the likelihood of plate deformations or conversely, misregistrations when the printing plate is not properly positioned against one or more of the required registration members.

Various conventional printing plate registration detection systems have been employed to help detect whether or not a required registration of a printing plate has been achieved. For example, in commonly-assigned U.S. Pat. No. 6,510,793

(Kerr et al.), which is herein incorporated by reference, describes a electronic printing plate registration system in which registration is established when the edges of a printing plate contacts all of three electrically conductive members to create a short between all of these conductive members. In one embodiment, Kerr et al. teach the use of a signal generator that generates an electrical signal at each of two of the three conductive members which act as "emitter" members. An electrical short detection system employs a short detector that senses both the electrical signals at the remaining third conductive member which acts a "receiver" member. In this regard, the electrical detector is adapted to detect both the electrical signals provided by the two "emitter" conductive members. Kerr et al. teach the use of two signals having different characteristics (e.g. frequency) to determine whether a misregistration is created by an absence of contact between the printing plate and a particular one of the two emitter members. The plate detection system described by Kerr et al. is an example of a conventional detection system in which the detection of contact between the printing plate and any given one registration member is dependent on the presence contact between the printing plate and another of the registration members. There is a need for improved methods and apparatus for properly registering one or more printing plates during a printing plate processing operation.

There is a need for an imaging apparatus with improved printing plate registration abilities.

There is a need for a perforation apparatus with improved printing plate registration abilities.

SUMMARY OF THE INVENTION

Briefly, according to one aspect of the present invention a method for registering a printing plate against a plurality of registration members includes providing a surface adapted for supporting the printing plate and a first member adapted for pivoting about first pivot point. The printing plate is engaged with one or more elements provided on a second member that is coupled to the first member, the second member adapted for pivoting about a second pivot point separated from the first pivot point. The first member is moved towards the plurality of registration members, detecting contact between the printing plate and the plurality of registration members after the first member has been moved. A first value is determined to correspond to a first force that when applied to the second member, causes the second member to pivot and separate the printing plate from a contacted registration member. The printing plate is moved to establish contact between the printing plate and each of the plurality of registration members, wherein moving the printing plate to establish contact between the printing plate and each of the plurality of registration members comprises applying a second force to the second member, the second force being determined based at least on the first value.

The invention and its objects and advantages will become more apparent in the detailed description of the preferred embodiment presented below.

BRIEF DESCRIPTION OF THE DRAWINGS

Embodiments and applications of the invention are illustrated by the attached non-limiting drawings. The attached drawings are for purposes of illustrating the concepts of the invention and may not be to scale.

DETAILED DESCRIPTION OF THE INVENTION

Figure 1:
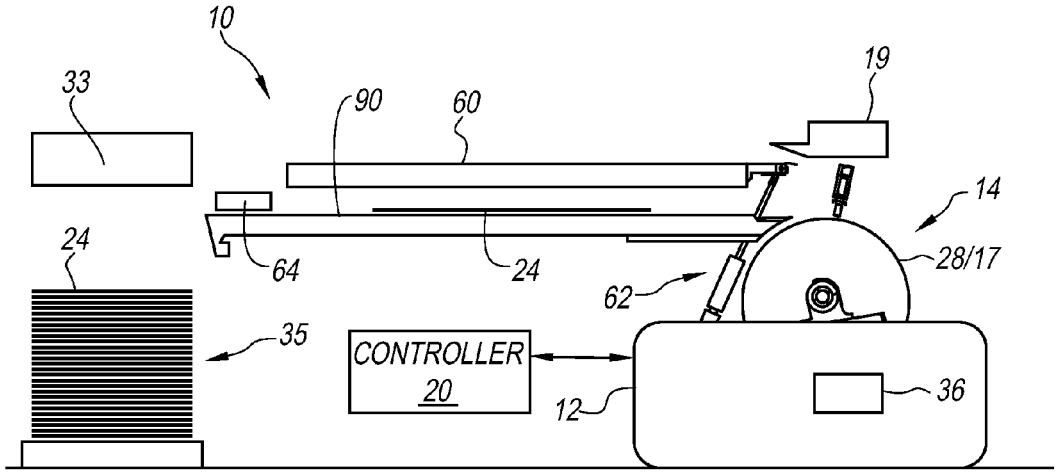
FIG. 1 shows an apparatus according to an example embodiment of the invention.

Throughout the following description specific details are presented to provide a more thorough understanding to persons skilled in the art. However, well-known elements may not have been shown or described in detail to avoid unnecessarily obscuring the disclosure. Accordingly, the description and drawings are to be regarded in an illustrative, rather than a restrictive sense.

FIGS. 1-4 schematically show a printing plate imaging apparatus 10 as per an example embodiment of the invention. In the embodiment of FIGS. 1-4, imaging apparatus 10 is a computer-to-plate imaging apparatus. Imaging apparatus 10 comprises a frame 12 supporting an image recording system 14, a staging support surface 90, a plate exchange surface 17, a transfer support surface 60, a perforation system 19, and a controller 20.

Controller 20 can comprise a microprocessor such as a programmable general purpose microprocessor, a dedicated microprocessor or micro-controller, or any other system that can receive signals from various sensors, and from external and internal data sources and that can generate control signals to cause actuators and motors within imaging apparatus 10 to operate in a controlled manner to form imaged printing plates 24. Controller 20 can comprise a plurality of controllers.

Image recording system 14 comprises an imaging head 22 adapted to take image-forming actions within an image forming area of an imaging support surface 28 so that an image can be formed on each of one or more printing plates 24 loaded within the image forming area on imaging support surface 28. In the illustrated embodiment, a plurality of printing plates 24 including printing plate 24A and printing plate 24B is supported on imaging support surface 28. However, this is not limiting and in other embodiments, imaging support surface 28 can be capable of supporting a different number of printing plates 24 in a manner that allows imaging head 22 to form images on each of printing plates 24 held thereby. Printing plates 24A and 24B can include different sizes or substantially the same size as shown in the illustrated embodiment. In this example embodiment, each of the printing plates 24 includes an electrically conductive material. In some example embodiments, each printing plate 24 is made from an electrically conductive substrate. In some example embodiments, each printing plate 24 is formed from a plastic or other substrate having an electrically conductive layer or coating.

Imaging head 22 generates one or more modulated radiation beams or channels that apply image modulated energy onto printing plates 24A and 24B. Imaging head 22 can move along a sub-scanning axis SSA while a motor 36 or other actuator moves the imaging support surface 28 along a main scanning axis MSA such that image forming actions can be taken over an image forming area of imaging support surface 28 on which printing plates 24A and 24B are supported.

Imaging head 22 is illustrated as providing two light emission channel sources 30 and 32 which can each comprise, for example, a source of laser light and laser modulation systems (not shown) of a kind known to those of skill in the art, each capable of taking image forming actions on printing plates 24 located within the image forming area. In some embodiments, light emission channel sources 30 and 32 can be independently controlled, each source applying modulated energy to printing plates 24A and 24B. In yet other embodiments of this type, a single light emission channel source can be used to generate a modulated light beam that can be directed across the entire image forming area.

In various embodiments, not illustrated, various types of imaging technology can be used in imaging head 22 to form an image pattern on printing plates 24A and 24B. For example, and without limitation, thermal printing plate image forming techniques known to those of skill in the art can be used. The choice of a suitable light emission source can be motivated by the type of printing plate 24 that is to be imaged.

In the embodiment of FIGS. 1-4, imaging support surface 28 illustrates an external drum-type of imaging support surface having a generally cylindrical exterior surface 34. Accordingly, in the embodiment of FIG. 2, main scanning axis MSA is illustrated as extending along an axis that is parallel to a direction of rotation of exterior surface 34. However, in other embodiments imaging support surface 28 can comprise an internal drum or a flatbed support surface. In the external drum embodiment illustrated, printing plates 24A and 24B are held on exterior surface 34 by clamping forces, electrostatic attraction, vacuum force or other attractive forces supplied respectively by plate clamps, electrostatic systems, vacuum systems, or other plate attracting systems (not shown).

During imaging operations, controller 20 causes image modulated beams of light from imaging head 22 to be scanned over the imaging forming area by a combination of operating a main scanning motor 36 to rotate imaging support surface 28 along main scanning axis MSA and translating imaging head 22 in the sub-scanning direction by causing rotation of a threaded screw 38 to which light emission channel sources 30 and 32 are attached in a manner that causes them to advance in a linear fashion down the length of threaded screw 38 as threaded screw 38 is rotated. It is understood that other mechanical translation systems known in the art can be used for this purpose. In some embodiments, light emission channel sources 30 and 32 can be controlled to move independently of one another along sub-scanning axis SSA. In other example embodiments, other well-known light beam scanning systems, such as those that employ rotating mirrors, can be used to scan image modulated light across the image forming area of imaging support surface 28.

In the embodiment illustrated, a staging support surface 90 is provided and is adapted to exchange various printing plates 24 (e.g. printing plates 24A and 24B) with imaging support surface 28. Printing plates 24 can be provided to staging support surface 90 for subsequent transfer to imaging support surface 28 in various ways. For example, plate handling mechanism 33 can be used to pick each printing plate 24 from one or more printing plate stacks 35 and transfer each printing plate 24 to staging support surface 90 by various methods as are well known in the art. Printing plate stacks 35 can be arranged or grouped in various manners, including by plate size, type, etc. Cassettes, pallets, and other containing members are regularly employed to group a plurality of printing plates 24. The printing plates 24 in printing plate stack 35 are shown separated from one another for clarity. Interleave or slip-sheets can be employed to separate adjacent printing plates 24 from one another in printing plate stack 35.

In this example embodiment, once a printing plate 24 is transferred to staging support surface 90, a plate positioning system 64 is operated to engage with a surface of the printing plate 24 and move it, at least in part, from staging support surface 90 onto imaging support surface 28. In this regard, it is desired that the printing plate 24 be transferred to imaging support surface 28 such that one of its edges is in contact and aligned with each of an associated set of registration members 40.

In this example embodiment, imaging apparatus 10 has a transfer support surface 60 and a positioning system 62. In this example embodiment, transfer support surface 60 is sized to receive, hold and/or deliver a plurality of printing plates 24 at the same time. In this example embodiment, positioning system 62 is connected between frame 12 and transfer support surface 60 and defines a movement path for transfer support surface 60 between a transfer position shown in FIG. 3 and a perforation position shown in FIG. 4.

When transfer support surface 60 is in the transfer position, printing plates 24A and 24B can be transferred between imaging support surface 28 and transfer support surface 60. Depending on the desired flow of the printing plates 24 through the apparatus 10, printing plates 24A and 24B can be transferred from transfer support surface 60 to imaging support surface 28, or from imaging support surface 28 to transfer support surface 60 when transfer support surface 60 is in the transfer position.

In this illustrated embodiment, printing plates 24 are transferred after they are imaged by imaging head 22. In this illustrated embodiment, transferred printing plates 24 can be perforated at the perforation position by perforation system 19. In this example embodiment, perforation system 19 perforates printing plates 24 with various punches and is herein referred to as punching system 19. While it is common in the industry for punches to be used to perforate printing plates, it will be appreciated that there are a variety of other ways in which the perforations can be formed. For example, and without limitation, laser cutting, thermal cutting, drilling, chemical etching, ablation, and other well known mechanical, chemical, and electrical processes can be employed. In some embodiments of the invention, printing plates 24 can be transferred to other systems for other forms of processing.

When transfer support surface 60 is in the perforation position, printing plates 24A and 24B are positioned proximate to various punches (not shown) in punching system 19. In this example embodiment, punches are employed to punch holes or detents or other forms in the printing plates 24 that can be used to form registration features. These registration features can be employed for various reasons including to align the printing plates 24 on a printing press.

Figure 2:
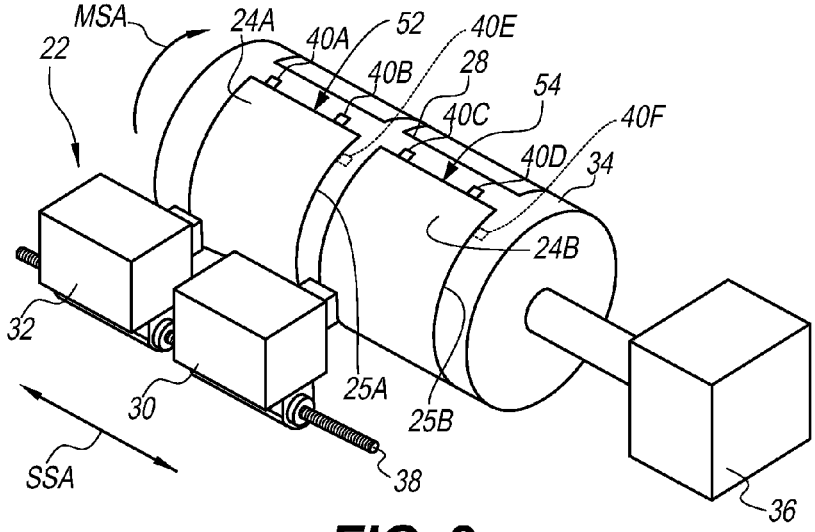
FIG. 2 shows a perspective view of an imaging head and imaging support surface of a type useful with the apparatus of FIG. 1.
Figure 3:
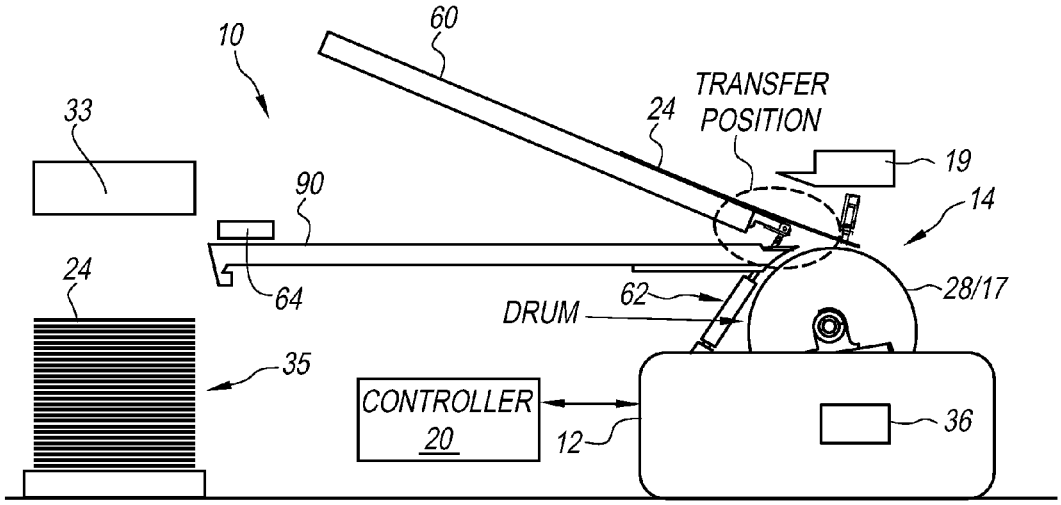
FIG. 3 shows a side view of the apparatus of FIG. 1 with a transfer support surface in a transfer position.
Figure 4:
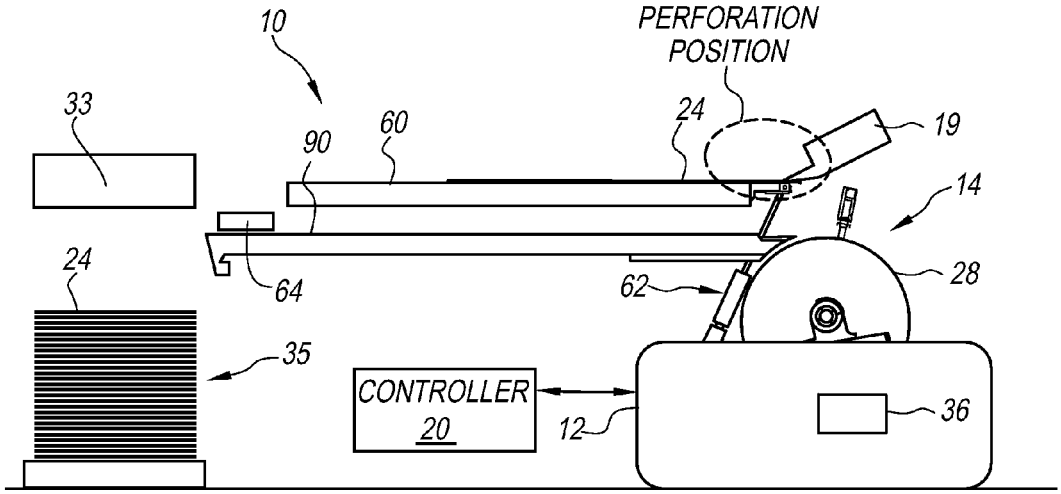
FIG. 4 shows a side view of the apparatus of FIG. 1 with the transfer support surface in a perforation position.

As is shown in greater detail in FIG. 2, exterior surface 34 has various sets of registration members 40A-40F including a first registration member 40A and a second registration member 40B associated with printing plate 24A, and a first registration member 40C and a second registration member 40D associated with printing plate 24B. In this example embodiment, printing plates 24A and 24B are to be positioned in contact with their associated set of registration members 40A-40F during an imaging operation to locate the printing plates 24 along the main-scanning axis MSA.

First and second registration members 40A and 40B are arranged to help control the position and orientation of registration edge 52 of printing plate 24A along main scanning axis MSA. Similarly, registration members 40C and 40D are arranged to help control the position and orientation of registration edge 54 of printing plate 24B along main scanning axis MSA.

Alignment of the first and second printing plates 24A and 24B along sub-scanning axis SSA can be provided in various ways. In a preferred embodiment, imaging head 22 has an integral edge detector (not shown) that is adapted to sense lateral edges 25A and 25B of respective printing plates 24A and 24B as imaging head 22 is moved past the printing plates during imaging operations. In this example embodiment, each of lateral edges 25A and 25B has a substantially perpendicular orientation to respective registration edges 52 and 54. Controller 20 receives signals from the edge detector and adjusts imaging operations so that images are formed on printing plates 24A and 24B in precise relation to the sensed lateral edges 25A and 25B of printing plates 24A and 24B respectively. Typically, integral edge detectors include an optical sensor that detects an edge based upon differences in an amount of light reflected thereby. However, integral edge detectors can take other forms known to those of skill in the art including magnetic field detectors, electrical sensors and contact detectors.

Alternatively, alignment along the sub-scanning axis SSA during imaging can be provided by additional third registration members 40E and 40F as shown in broken lines in FIG. 2. When employed, third registration members 40E and 40F are positioned for respective contact with lateral edges 25A and 25B to help accurately position printing plate 24A and printing plate 24B along sub-scanning axis SSA. In this regard, registration members 40A, 40B, and 40E define a three-point registration system for printing plate 24A during imaging, and registration members 40C, 40D, and 40F define a three point registration system for printing plate 24B during imaging.

Figure 5:
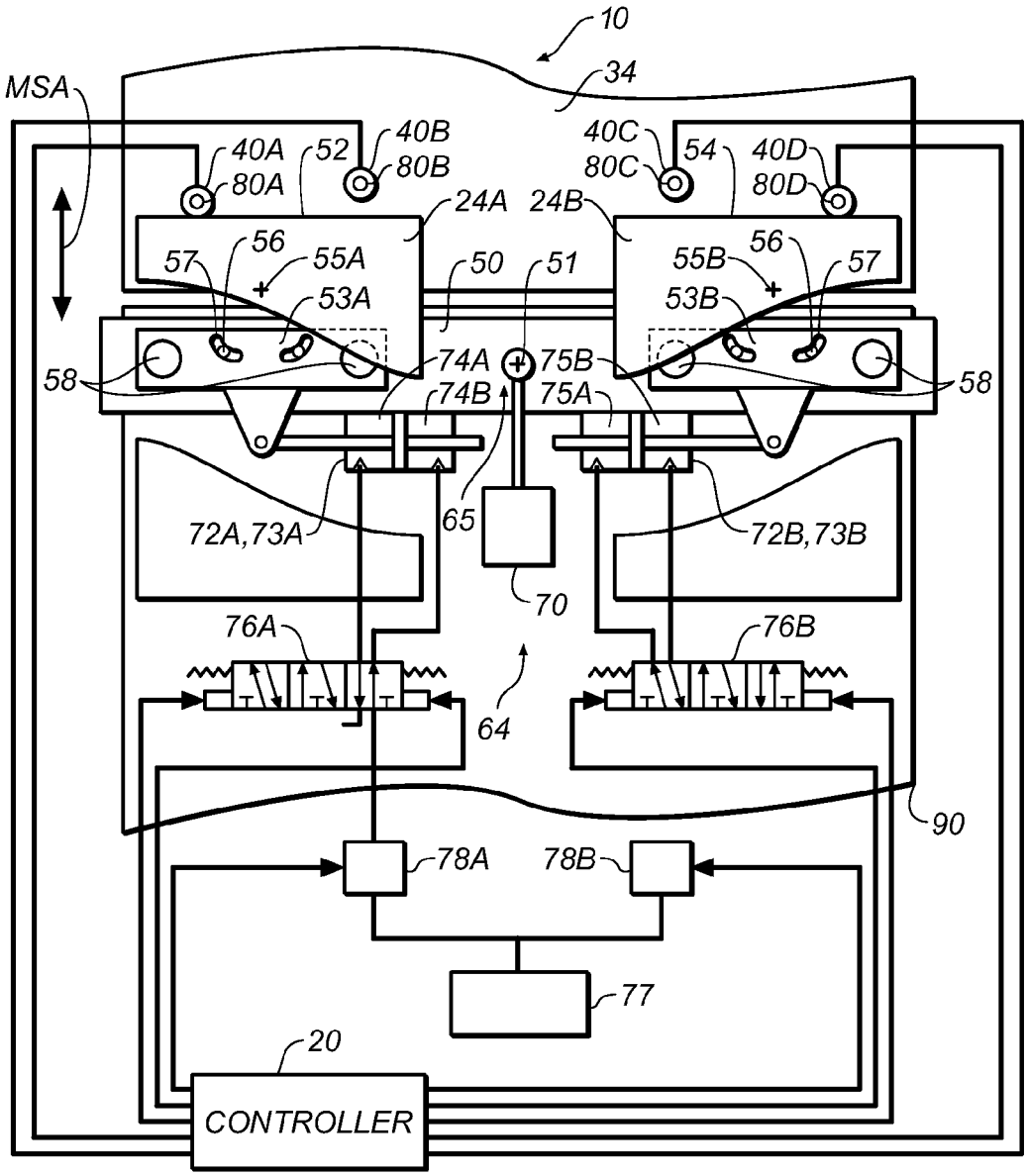
FIG. 5 schematically shows a plan view of a portion of the apparatus including a support surface with a plurality of printing plates supported thereon, a plurality of registration members, and plate positioning system as per an example embodiment of the invention.

FIG. 5 schematically shows a portion of apparatus 10 including a plan view of a portion of staging support surface 90, a portion of exterior surface 34 and printing plates 24A and 248 supported thereon. Printing plates 24A and 24B are shown sectioned for clarity. FIG. 5 additionally shows registration members 40A, 40B, 40C, and 40D positioned relative to exterior surface 34. In this example embodiment, each of the registration members 40 assumes a fixed location relative to exterior surface 34. In this example embodiment, each registration member 40A-40F is affixed to exterior surface 34. In some example embodiments, various sets of registration members 40A-40F are selected from a plurality of sets of registrations members 40A-40F, each set being positioned to engage a different sized printing plate 24 as described in commonly-assigned U.S. Pat. No. 6,755,132 (Cummings). Various members of the plurality of registration members 40A-40F can be positioned for contact with various printing plates 24 of a select size. In this example embodiment, various members of the plurality of registration members 40A-40F are positioned offset from others of the registration members 40A-40F in a direction of main-scanning axis MSA. Offset positioning of the various registration members 40A-40F can be employed to facilitate a positioning of various printing plates 24 having different sizes. The offsets have been exaggerated for clarity in FIG. 5.

In some example embodiments, a registration member 40A-40F does not assume a fixed position, but rather, can be repositioned as required. For example, the repositioning of a registration member 40A-40F can include moving the registration member 40A-40F to a location suitable for contact with an edge of a printing plate 24. In one example embodiment, a registration member 40A-40F can be repositionable between a first position which is recessed below a support surface and a second position where the registration member 40A-40F protrudes from the support surface sufficiently to accommodate the desired contact with an edge of a printing plate 24. The repositioning of a registration member 40A-40F can include moving a surface of the registration member 40A-40F to a location suitable for contact with an edge of a printing plate 24. For example, a registration member 40A-40F can include a cam-like surface wherein a portion of the surface is positioned for contact with an edge of a printing plate 24 when the registration member 40A-40F is rotated about an axis of the cam-like surface.

FIG. 5 schematically shows a plan view of plate positioning system 64. In this example embodiment, positioning system 64 includes a wiffle-tree mechanism 65. Wiffle-tree mechanisms can be employed to distribute forces in a substantially even manner. A common waffle-tree mechanism is employed in an automotive windscreen wiper to distribute the loading from the wiper arm evenly along the wiper blade. In this example embodiment, wiffle-tree mechanism 65 includes a first member 50 and plurality of second members, including second member 53A and second member 53B. In this example embodiment, first member 50 is an elongate member adapted to pivot about a first pivot point 51. A drive 70 is provided to move plate positioning system 64 towards the plurality of registration members 40A-40F. In this example embodiment drive 70 is coupled to first member 50 and is adapted to translate first member 50 towards the plurality of registration members 40A-40F. In this example embodiment of the invention, drive 70 is adapted for providing a motive force oriented along a direction that intersect first pivot 51. Drive 70 can include any suitable electric motors or actuators, transmission members, guides and positional sensors. In this example embodiment, drive 70 is adapted for moving plate positioning system 64 to various locations on a path of travel towards registration members 40A-40F. In this example embodiment, drive 70 is adapted for incrementing plate positioning system 64 towards registration members 40A-40F.

As shown in FIG. 5, each of second members 53A, 53B is pivotally coupled to first member 50. In some example embodiment, a second member is pivotally coupled to first member 50 via a fixed second pivot. In this example embodiment, each of the second members 53A, 53B is pivotally coupled to first member 50 via a "virtual" second pivot, i.e. shown as second pivot points 55A and 55B, each represented by a "+". Each second member 53A, 53B is adapted to pivot about an associated second pivot point 55A, 55B via pin members 56 and guide slots 57. In this example embodiment, pin members 56 secure each second member 53A, 53B to first member 50 in manner that permits relative movement between the first and second members via guide slots 57.

Each of the second members 53A, 53B includes various elements adapted for engaging a surface or edge of an associated one of printing plate 24A and 24B during a positioning of the printing plates. In this example embodiment, each second member 53A, 53B includes various gripping elements 58 that are adapted for securing an associated one of printing plate 24A and 24B. Suitable gripping elements 58 can include suction/vacuum cups or mechanical grippers or clamps by way of non-limiting example. In this example embodiment, the gripping elements 58 are adapted to engage an associated one of printing plate 24A and 24B to move the printing plate in a desired manner. Movement of one of printing plate 24A and 24B can include translation of the printing plate under the influence of drive 70. Movement of one of printing plate 24A and 24B can include a pivoting movement of the printing plate under the influence of an actuator 72A, 72B coupled to each second member 53A, 53B. In this example embodiment, actuator 72A is coupled to second member 53A and actuator 72B is coupled to second member 53B.

Each actuator 72A, 72B is coupled to a second member 53A, 53B in manner suitable for pivoting the second member 53A, 53B about its associated second pivot point 55. Each actuator 72A, 72B is controllable to selectively apply a force along a desired direction to an associated second member 53A, 53B. In this example embodiment, each actuator 72A, 72B comprises a double acting cylinder, i.e. a respective one of double acting cylinders 73A and 73B, capable of both extending and retracting an actuating member (i.e. the cylinder rod in this example). In this example embodiment, each cylinder 73A, 73B employs air as a working fluid although other fluids may be employed in other example embodiments. In this example embodiment, the working fluid is selectively provided to a desired one of chamber 74A and 74B of cylinder 73A via a three-way valve 76A. In this example embodiment, the working fluid is selectively provided to a desired one of chamber 75A and 75B of cylinder 73B via a three-way valve 76B. The working fluid is provided to each of valves 76A and 76B from a source 77. The pressure of the working fluid provided to each of cylinders 73A and 73B is controlled respectively by analog pressure regulators 78A and 78B. In this example embodiment each actuator 72A, 72B is independently controllable. Without limitation, other example embodiments of the invention can employ other suitable forms of actuators 72A, 72B.

Referring back to FIG. 5, apparatus 10 includes a plurality of sensors 80A, 80B adapted for detecting contact between the registration members 40A-40F and a printing plate 24. In this illustrated embodiment, sensor 80A is associated with registration member 40A; sensor 80B is associated with registration member 4013; sensor 80C is associated with registration member 40C; and sensor 80D is associated with registration member 40D. In this example embodiment, a first set of sensors, including sensors 80A and 80B, is associated with the registration of printing plate 24A while a second set of sensors, including sensors 80C and 80D, is associated with the registration of printing plate 24B. In some example embodiments, each sensor 80A-80D is a separate component distinct from an associated one of the registration members 40A-40F. In other example embodiments, each sensor 80A-80D forms part of an associated one of the registration members 40A-40F. In yet other example embodiments, each sensor 80A-80D is integrated into an assembly with an associated one of the registration members 40A-40F.

In some sensor systems (e.g. electrical contact sensors), contact between a printing plate 24 and a given registration member 40A-40F is detected only when contact between the printing plate 24 and another of the registration members 40A-40F is established. For example, each of the registration members 40A-40F can include an electrically isolated electrical contact. An electrical signal is applied to one of these registration members 40A-40F which acts as an emitter member while at least one other of the registration members 40A-40F acts as receiver element. When an electrically conductive printing plate 24 closes the electrical circuit between the emitter member and the receiver member, registration is indicated. It is to be noted however, that this detection system can sometimes present difficulties since the printing plate 24 itself is expected to form part of the closed electrical circuit that indicates registration. Printing plates 24 do not always make the most reliable switch components, especially when their imageable coatings are smeared across the plate edges during a typical shearing operation that is employed to form the printing plates 24.

In this example embodiment of the invention, each sensor 80A-80D is capable of detecting contact between an associated registration member 40A-40F and a printing plate 24 independently of the presence of contact between the printing plate 24 and another of the registration members 40A-40F. In this example embodiment, each sensor 80A-80D is adapted for detecting a single point of contact between a printing plate 24 and the plurality of registration members 40A-40F. In some example embodiments, each sensor 80A-80D includes a micro-switch activated by contact with an associated one of the registration members 40A-40F. In some example embodiments, flexure systems are employed to reduce the activation throw of a micro-switch to very low levels on the order of fifty (50) microns or so. In some example embodiments, sensors 80A-80D employing strain gauges are used. Strain gauges can be employed to determine the presence of contact between a printing plate 24 and a registration member 40 as well as the amount of force applied by the printing plate 24 during the contact.

During the registration process, it is a rare occasion when each registration member 40A-40F in a set of the registration members 40A-40F will be contacted simultaneously by an associated one printing plates 24A and 24B. This situation can be particularly prevalent when main-scan offsets are employed by various ones of the registration members 40A-40F as shown in FIG. 5. Typically, a single registration member 40A-40F in the registration member set is first contacted and various articulation points within the wiffle-tree mechanism 65 (e.g. first pivot point 51 and a second pivot point 55A, 55B) allow for a subsequent contact with an additional registration member 40A-40F. In this example embodiment, the desired registration requires contact between registration edge 52 of printing plate 24A with registration members 40A and 40B and between registration edge 54 of printing plate 24B with registration members 40C and 40D.

Various factors can influence the outcome of the desired registration. For example, frictional effects between staging support surface 90 and each of the printing plates 24 can adversely affect the outcome. In particular, larger frictional forces are typically associated with larger printing plates 24. Other sources of friction can include, but are not limited to, internal friction between various components of plate positioning system 64 including wiffle-tree mechanism 65. In this example embodiment, drive 70 provides the primary motive force employed to overcome the frictional effects during the registration procedure. In this example embodiment, the large moment arm provided by first member 50 allows for each of printing plates 24A and 24B to pivot about first pivot point 51 relatively easily. However, the smaller moment arms associated with each of the second members 53A, 53B can lead to difficulties when an engaged one of printing plate 24A and 24B is required to pivot about a respective one of the second pivot points 55A and 55B. In many cases, one of printing plate 24A and 24B will register with each member of its associated set of registration members 40A-40F while the other of printing plate 24A and 24B will only contact a single registration member 40 of its associated set of registration members 40A-40F. It is additionally noted that other problems can arise when attempts are made to mechanically force a printing plate 24 against a registration member 40A-40F in hopes of establishing contact with another of the registration pins 40A-40F. In this regard, undesired edge deformations and plate buckling can arise.

To avoid these problems, this example embodiment of the invention employs actuators 72A, 72B to operate in a "power assist" mode to help rotate a printing plate 24 towards a registration member 40A-40F that has not been contacted yet. In this example embodiment, actuators 72A, 72B can be employed to help overcome frictional effects associated with positioning system 64 and frictional loading created between the printing plate 24 and components such as staging support surface 90 and a contacted registration member 40A-40F.

Figure 6:
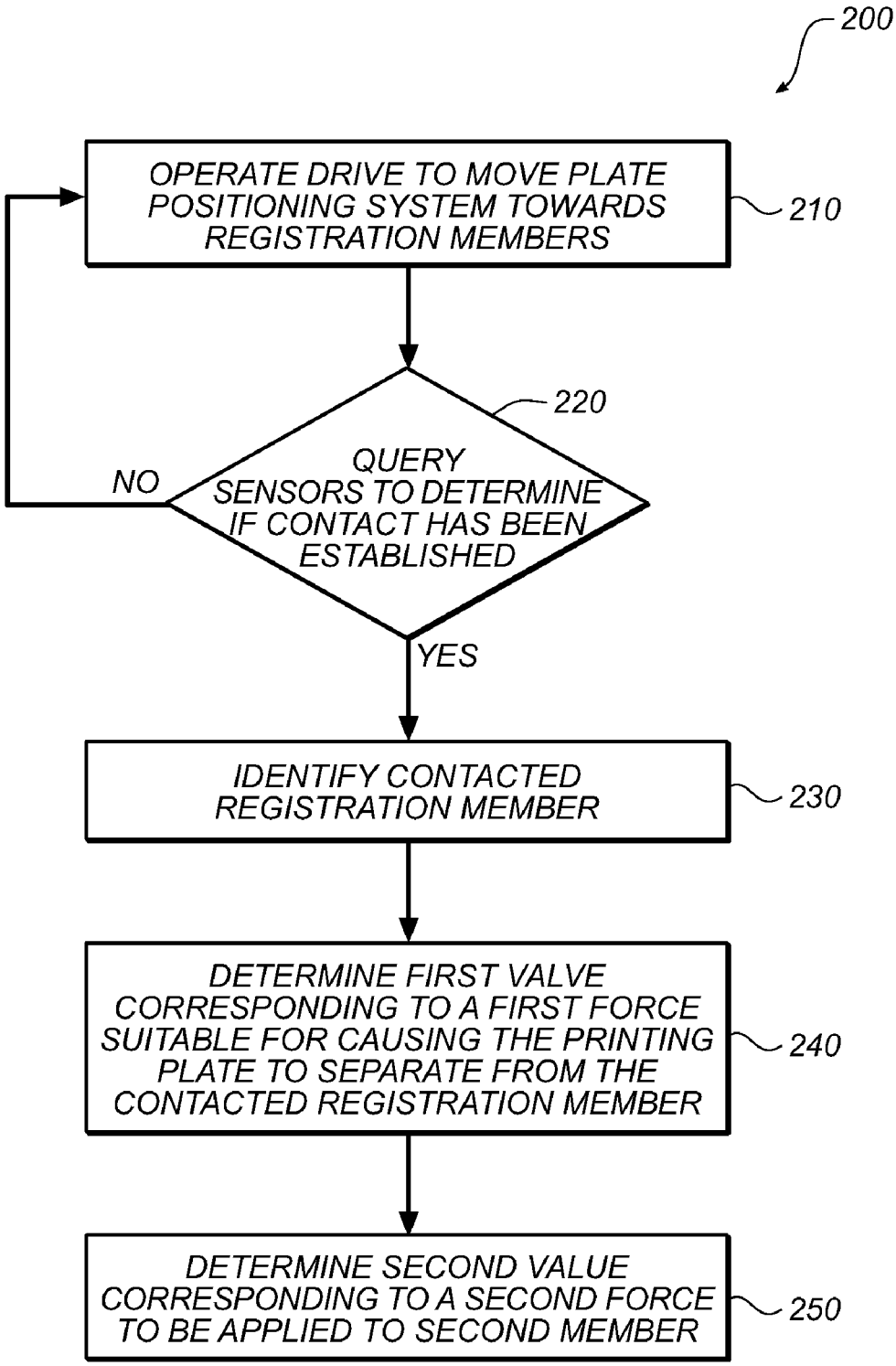
FIG. 6 shows a flow chart representing a calibration method employed by a plate positioning system according to an example embodiment of the invention.

A calibration method 200 employed by plate positioning system 64 in one example embodiment is represented by the flow chart of FIG. 6. For simplicity, calibration method 200 is described in conjunction with the operation of actuator 72A. The operation of actuator 72B is calibrated in a similar manner. It is noted that the operation of wiffle-tree mechanism 65 can allow for the calibration of actuator 72B at substantially the same time as the calibration of actuator 72A.

In step 210, drive 70 is operated to move plate positioning system 64 towards the plurality of registration members 40A-40F. In this example embodiment, actuator 72A is operated to not actively pivot second member 53A about its associated pivot point 55A. That is, actuator 72A is operated to not substantially constrain second member 53A from pivoting or substantially force second member 53A to pivot as positioning system 64 is moved in step 210. In this example embodiment, second member 53A is essentially free to pivot under the movement of plate positioning system 64 in step 210. In this example embodiment, controller 20 applies appropriate signals to valve 76A so that neither of the chambers 74A and 74B of the cylinder 73A are pressurized by the working fluid to allow for an unconstrained pivoting of second member 53A. In this example embodiment, plate positioning system 64 is moved to a first desired position relative to the registration members 40A-40F. A positional encoder (not shown) or the like can be employed during the positioning of plate positioning system 64.

In step 220, each of the sensors 80A and 80B is queried to determine if the presence of contact has been established between printing plate 24A and the registration members 40A and 40B. If no contact has been established, step 210 is repeated and plate positioning system 64 is again moved towards the registration members 40A-40F. In some example embodiments, plate positioning system 64 is moved by the same distance as that employed during a previous movement, while in other example embodiments, plate positioning system is moved by a different distance than that employed during a previous movement of plate positioning system 64.

If contact has been detected at one of the first and second registration members 40A and 40B, the contacted registration member 40 is identified in step 230. In this example embodiment, sensor 80A indicates that registration member 40A has been contacted as represented in FIG. 5. In this example embodiment, this determination is made by controller 20 based at least on information contained in a signal provided by sensor 80A. In this example embodiment, an accurate determination of the specific contacted registration member 40A-40F is made since each sensor 80A-80D is capable of detecting contact between a printing plate 24 and an associated one of the registration members 40A-40F regardless of the status of contact between the printing plate 24 and another one of the registration members 40A-40F.

In step 240, the determination of a first value corresponding to a first force, that when applied to second member 53A, causes second member 53A to separate from contacted registration member 40A is made. In this example embodiment, the first force is determined from actual operating conditions. In this example embodiment, once controller 20 has determined that registration member 40A has been contacted by printing plate 24A, controller 20 activates actuator 72A to pivot away from contacted registration member 40A towards un-contacted registration member 40B until contact is no longer established with registration member 40A. In this example embodiment, controller 20 controls valve 76A to cause cylinder 73A to extend in a direction suitable for pivoting second member 53A away from contacted registration member 40A. In this example embodiment, controller 20 sends appropriate signals to valve 73A to cause chamber 74A to be pressurized with the working fluid. In this regard, controller 20 controls pressure regulator 78A to incrementally increase the pressure of the working fluid provided to chamber 73A. Controller 20 monitors sensor 80A each time the pressure is incremented to determine a specific pressure value (i.e. a first value) in which the resulting first force that is applied by actuator 72A is sufficient to cause a separation between the printing plate 24A and registration member 40A.

In this example embodiment, the generated first force is sufficient to overcome a static frictional forces associated with plate positioning system 64 itself and static frictional forces associated with the supporting of printing plate 24A on staging support surface 90. It is understood that although the first value corresponding to the first force is in "pressure" units in this example embodiment, other values can be employed in other example embodiments. For example, a first value can include a value that directly represents the generated first force or any value representing a parameter that results in the first force being generated. In this example embodiment, drive 70 is not operated to move first member 50 when the first force is being determined. In this example embodiment, if controller 20 determines that both registration members 40A and 40B are contacted during step 230, a previously derived first value or a first value corresponding to the calibration of actuator 72B is employed. It is noted that although the first value corresponding to the first force has been determined by actual operation of plate positioning system 64 in this example embodiment, the first value can be determined by various calculations or simulation exercises in other example embodiments of the invention.

In step 250 a second value corresponding to a second force that is to be applied to the second member 53A is determined. In this example embodiment, the second force is selected to be different than the first force. In this example embodiment, the second force includes a magnitude that less than the magnitude of the first force. In this example embodiment, the second force is insufficient to cause printing plate 24A to move when printing plate 24 is statically positioned on staging support surface 90. In this example embodiment, the second force is insufficient to cause printing plate 24A to move in the absence of any other force applied to printing plate 24A.

In various example embodiments, the second force is determined based at least on the first force. In this example embodiment, the second value corresponding to the second force is determined based at least on the first value. In this example embodiment, controller 20 determines the second value as a percentage of the first value. In some example embodiments, the second value is determined to be less than, or equal to 90% of the first value. In other example embodiments, the second value is determined to be less than, or equal to 80% of the first value. In yet other example embodiments, the second value is determined to be less than, or equal to 70% of the first value. In this example embodiment, the second value is selected not to actively drive printing plate 24A into a registration position defined by contact with each of registration members 40A and 40B, but rather, to assist printing plate 24A in overcoming frictional effects that oppose its movement so that it can be registered by plate positioning system 64. Calibration method 200 is also repeated for the second member 53B associated with printing plate 24B. Each of the second values is maintained within a memory accessible by controller 20. In this example embodiment, the second values are employed during a registration process of the printing plates 24.

In some example embodiments, information pertaining to the characteristics of the printing plate 24 associated with a particular second value is also maintained in memory. This information can include a printing plate type, and printing plate dimensions including width, length and thickness. In some example embodiments, a particular second value is maintained in memory for each of a number of different printing plates 24 that is to be processed by apparatus 10. In some example embodiments, a same second value is employed to register each of two different printing plates 24 if the differences between the printing plates 24 are considered to fall within an acceptable range. For example, a second value associated with a first printing plate 24 is stored in memory together with information comprising a main-scan size, a sub-scan size and thickness of the first printing plate 24. If a second printing plate 24 is within +/− 10 mm of each of the main-scan and sub-scan sizes of the first printing plate 24 and if the second printing plate 24 includes a same thickness as the first printing plate 24, the second value associated with the first printing plate 24 can also be employed during the registration of the second printing plate 24. This can enhance productivity by avoiding having to repeat calibration method 200 for the second printing plate 24.

Figure 7:
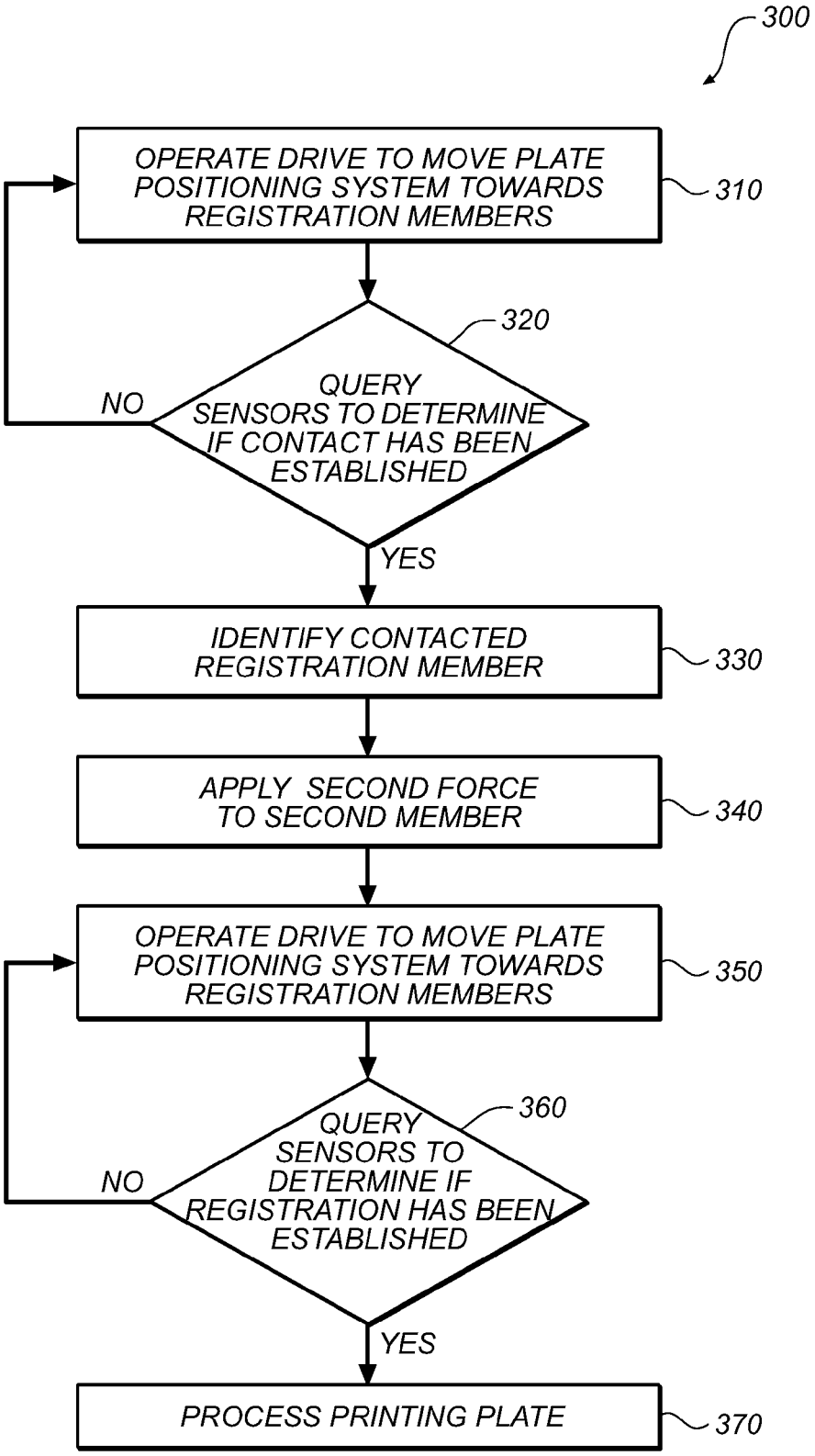
FIG. 7 shows a flow chart representing a registration method employed by a plate positioning system according to an example embodiment of the invention.

FIG. 7 shows a flow chart representing a method 300 for registering a printing plate 24 in accordance with an example embodiment of the invention. In this example embodiment, second values derived during the practice of the calibration method 200 are employed in the registration method 300. For simplicity, registration method 300 is described in association with the registration of printing plate 24A. Printing plate 24B is registered in a similar manner. It is noted that the operation of wiffle-tree mechanism 65 can allow for the registration of printing plate 24B at substantially the same time as the registration of printing plate 24A. In step 310, drive 70 is employed to move plate positioning system 64 towards the plurality of registration members 40A-40F in a manner similar to that employed in step 210 of calibration method 200. In this example embodiment, each actuator 72A, 72B is operated to allow an associated one of second members 53A, 53B to freely pivot during this movement. In this example embodiment, positioning system 64 is incremented to a first desired position relative to the registration members 40A-40F. In this example embodiment, first pivot point 51 is translated towards the plurality of registration members 40A-40F.

In a manner similar to that employed in step 220, each of the sensors 80A and 80B is queried to determine if the presence of contact has been established between printing plate 24A and registration members 40A and 40B in step 320. If no contact has been established at one of the registration members 40A and 40B, step 310 is repeated and positioning system 64 is again incremented towards the registration members 40A and 40B.

If contact has been detected at one of the first and second registration members 40A and 40B, the contacted registration member is identified in step 330. For illustration purposes we will assume that sensor 80A indicates that registration member 40A has been contacted. In this example embodiment, this determination is made by controller 20 from information contained in signals provided by sensor 80A.

In step 340, actuator 72A is activated to apply a second force to second member 53A. In this example embodiment, controller 20 accesses the second value stored in memory and controls pressure regulator 78A to provide the working fluid with a pressure corresponding to the second value. Accordingly working fluid comprising a pressure related to the second level is provided to cylinder 73A. In this example embodiment, controller 20 controls valve 76A to cause this pressurized fluid to be provided to chamber 74A of cylinder 73A. In this regard, controller 20 has selected chamber 73A as being the appropriate chamber to pressurize and cause actuator 72A to apply a moment to second member 53A oriented in a direction suitable for assisting second member 53A to pivot towards un-contacted registration member 40B during a subsequent step. In the absence of any other force being applied to second member 53A, the second force is insufficient to cause second member 53A to pivot towards un-contacted registration member 40B in this example embodiment of the invention.

In step 350, drive 70 is activated to move positioning system 64 to once again move printing plate 24A towards registration members 40A and 40B. In this example embodiment, drive 70 is operated to move first member 50 towards the plurality of registration members 40. The movement of first member 50 in turn causes a movement of second member 53A. In this example embodiment, the movement of second member 53A includes a pivoting movement towards the un-contacted registration member 40B. In this example embodiment, the application of the second force by actuator 72A to the second member 53A assists in pivoting the second member 53A towards the un-contacted registration member 40B. Rather than forcing printing plate 24A into contact solely under the influence of drive 70, the application of the second force to second member 53A helps guide printing plate 24A towards registration member 40B and advantageously reduces occurrences of plate buckling or edge deformations by helping to overcome frictional effects associated with the registration process.

In step 360, controller 20 queries sensors 80 to determine if both registration members 40A and 40B are contacted by printing plate 24A. If contact is determined to exist with both of the registration members 40A and 40B, controller 20 determines that printing plate 24A has been registered. If an absence of contact is determined to exist with one of registration members 45A and 45B, controller 20 determines that the printing plate 24A has not been registered, and step 350 is repeated. In this example embodiment, the registration method 300 is also conducted with printing plate 24B.

Once it has been determined that printing plate 24A has been registered, a subsequent processing of the printing plate 24A is undertaken in step 370. In this example embodiment, controller 20 operates image recording system 14 to form one or more images on a surface of printing plate 24A. In some example embodiments, controller 20 operates a punch system to perforate printing plate 24A. It is understood that other forms of processing can be undertaken in other example embodiments of the invention.

Various example embodiments of the invention have been described in terms of registering a printing plate 24 on staging support surface 90. It is to be noted however, that any suitable surface adapted to receive and support a printing plate 24 can be employed by the present invention.

In the described example embodiments, image recording system 14 and punch system 19 were part of a common apparatus 10. In other example embodiments, different apparatus may be employed.

The invention has been described in detail with particular reference to certain preferred embodiments thereof, but it will be understood that variations and modifications can be effected within the scope of the invention.

PARTS LIST

10 imaging apparatus
12 frame
14 image recording system
17 plate exchange surface
19 perforation/punch system
20 controller
22 imaging head
24 printing plates
24A printing plate
24B printing plate
25A lateral edge
25B lateral edge
28 imaging support surface
30 light emission channel source
32 light emission channel source
33 plate handling mechanism
34 exterior surface
35 printing plate stack
36 motor
38 threaded screw
40A first registration member
40B second registration member
40C first registration member
40D second registration member
40E third registration member
40F third registration member
50 first member
51 first pivot point
52 registration edge
53A second member
53B second member
54 registration edge
55A second pivot point
55B second pivot point
56 pin member
57 guide slot
58 gripping element
60 transfer support surface
62 positioning system
64 plate positioning system
65 wiffle-tree mechanism
70 drive
72A actuator
72B actuator
73A double acting cylinder
73B double acting cylinder
74A chamber
74B chamber
75A chamber
75B chamber
76A valve
76B valve
77 source
78A pressure regulator
78B pressure regulator
80A sensor
80B sensor
80C sensor
80D sensor
90 staging support surface
200 calibration method
210 operate drive to move plate positioning system towards registration members
220 query sensors
230 identify contacted registration member
240 determine first value corresponding to a first force suitable for causing the printing plate to separate from contacted registration member
250 determine second value corresponding to second force to be applied to second member
300 registration method
310 operate drive to move plate positioning system towards registration members
320 query sensors to determine if contact has been established
330 identify contacted registration member
340 apply second force to second member
350 operate drive to move plate positioning system towards registration members
360 query sensors to determine if registration has been established
370 process printing plate
MSA main scanning axis
SSA sub-scanning axis

The invention claimed is:

1. A method for registering a printing plate against a plurality of registration members, the method comprising:

providing a surface adapted for supporting the printing plate;

providing a first member adapted for pivoting about first pivot point;

engaging the printing plate with one or more elements provided on a second member that is coupled to the first member, the second member adapted for pivoting about a second pivot point separated from the first pivot point;

moving the first member towards the plurality of registration members, detecting contact between the printing plate and the plurality of registration members after the first member has been moved;

determining a first value corresponding to a first force that when applied to the second member, causes the second member to pivot and separate the printing plate from a contacted registration member; and moving the printing plate to establish contact between the printing plate and each of the plurality of registration members, wherein moving the printing plate to establish contact between the printing plate and each of the plurality of registration members comprises applying a second force to the second member, the second force being determined based at least on the first value.

2. The method of claim 1, wherein moving the printing plate to establish contact between the printing plate and each of the plurality of registration members comprises moving the first member to move the printing plate towards the plurality of registration members.

3. The method of claim 2, comprising providing an actuator coupled to the second member and operating the actuator to generate the second force.

4. The method of claim 3, wherein the second force is insufficient to cause the second member move the printing plate when the printing plate is statically positioned on the surface.

5. The method of claim 3, wherein the second force comprises a magnitude that is less than a magnitude of the first force.

6. The method of claim 3, wherein the second force corresponds to a second value, the second value being determined to be less than, or equal to 90% of the first value.

7. The method of claim 3, wherein the second force corresponds to a second value, the second value being determined to be less than, or equal to 70% of the first value.

8. The method of claim 1, wherein moving the printing plate to establish contact between the printing plate and each of the plurality of registration members comprises moving the first member a plurality of times to move the printing plate towards the plurality of registration members.

9. The method of claim 1, wherein moving the first member towards the plurality of registration members comprises translating the first pivot point towards the plurality of registration members.

10. The method of claim 9, comprising pivoting the first member about the first pivot point while translating the first member towards the plurality of registration members.

11. The method of claim 1, wherein at least one of the first pivot point and the second pivot point is a virtual pivot point.

12. The method of claim 1, wherein the one or more elements comprises at least one gripping element adapted for gripping the printing plate.

* * * * *